US005188344A

United States Patent [19]

Dabney

[11] Patent Number: 5,188,344

[45] Date of Patent: Feb. 23, 1993

[54] FORMED WIRE BOX SPRING WITH GRID LOCK SYSTEM

[75] Inventor: Upton R. Dabney, Georgetown, Ky.

[73] Assignee: Hoover Group, Inc., Alpharetta, Ga.

[21] Appl. No.: 858,581

[22] Filed: Mar. 27, 1992

Related U.S. Application Data

[63] Continuation of Ser. No. 606,506, Oct. 31, 1990, abandoned.

[51] Int. Cl.[5] ..... F16F 3/00

[52] U.S. Cl. ..... 267/103; 5/255

[58] Field of Search ..... 5/247, 255, 260, 267; 267/81, 103, 107

[56] References Cited

U.S. PATENT DOCUMENTS

| | | | |
|---|---|---|---|
| 4,339,834 | 4/1982 | Mizelle | 5/247 |
| 4,470,584 | 9/1984 | Mizelle | 5/247 |
| 4,771,995 | 9/1988 | Wells et al. | 267/103 |
| 4,779,293 | 10/1988 | Dabney et al. | 5/247 |
| 4,891,853 | 1/1990 | Dabney | 5/247 |
| 4,921,228 | 5/1990 | Lowe | 267/103 |
| 4,932,535 | 6/1990 | Dabney | 267/103 |

*Primary Examiner*—Robert J. Oberleitner
*Assistant Examiner*—Chris Schwartz
*Attorney, Agent, or Firm*—Harness, Dickey & Pierce

[57] ABSTRACT

A box spring assembly in which the support springs are designed so as to permit spring location independent of long wire location in the support deck. The mattress support deck is suspended on support springs which are interwoven and self-secured on crosswires so as to eliminate the need of retaining clips in the assembly. The mattress support deck is inhibited in its lateral motion by support springs disposed therein in an interference relation with the long wires of the support deck. So constructed, a manufacturer is enabled to distribute the support springs as required and desired on the frame regardless of the position of the long wires.

5 Claims, 3 Drawing Sheets

FORMED WIRE BOX SPRING WITH GRID LOCK SYSTEM

This is a continuation of U.S. patent application Ser. No. 606,506 filed Oct. 31, 1990, now abandoned.

BACKGROUND OF THE INVENTION

This invention relates generally to mattress foundation structures and more particularly to a box spring assembly of a type which utilizes non-coil springs. Box spring assemblies of this general type have been known since 1964, the first such spring assembly being disclosed in U.S. Pat. No. 3,286,281. Subsequently issued patents disclosing the same general type of box spring assembly are: U.S. Pat. Nos. 3,665,529; 3,680,157; 3,755,833; 3,824,639; 3,852,838; 4,060,862; 4,120,058; 4,131,961; 4,195,376; 4,218,790; 4,238,861; 4,251,892; 4,253,208; 4,339,834; 4,371,152; 4,398,765; 4,452,438; 4,470,584; 4,739,977; 4,779,293; 4,805,883; 4,867,424; 4,891,853; 4,921,228; and 4,932,535.

Box spring assemblies of the general type shown in the above list of patents, all of which are owned by the assignee of the present application, are advantageous with respect to conventional box spring assemblies using coil springs because they provide a desired stiffer foundation for the mattress and contain a reduced amount of wire. These box spring assemblies are also advantageous from the standpoints of prolonged service life, ease of assembly, and cost of manufacture.

Additional box spring assemblies of this general type are shown in U.S. Pat. Nos. 3,546,723; 3,596,299; 3,722,013; 3,825,960; 3,833,948; 3,835,485; 3,860,740; 3,990,131; 4,000,531; 4,559,654; and 4,730,357.

It is an object of the present invention to produce a box spring assembly in which the location of the spring modules is independent of the location of the long wires in the welded wire grid. It is another object of the present invention to enable a manufacturer to readily position the spring modules as desired on the frame of the assembly.

The present invention provides a box spring assembly that utilizes a welded wire grid and support springs which lock the grid into its proper position a predetermined distance above the frame assembly. The support springs of this invention are generally noiseless and have self-locking tops which enable the springs to be arranged in an "over and under" relationship with a single crosswire of the grid. Thus, the location and positioning of the springs is not dependent on the location of the long wires used in the welded wire grid. Such a construction enables the manufacturer to distribute the spring modules to provide support where it is particularly required in the specific box spring assembly. The support springs are also capable of being locked in a "dependent" relation with a pair of long wires in the grid. When so mounted the springs hold and secure the welded wire grid into a set position relative to the support frame.

The support springs of this invention are self-balancing in the sense that during assembly of the springs with the grid, all forces are in opposition to one another. Utilizing leaf spring tension in their upper ends, the springs are maintained in an assembled relation to the wire grid without the use of clips. To prevent bottoming out on the frame, the springs may also incorporate limited deflection characteristics.

In one embodiment of the invention, the springs are formed so that the upper torsion bar components are connected by a "straight diagonal" connecting wire. In a second embodiment, the springs utilize a zig-zag or "stairstepped" connecting wire. A third embodiment uses a curved connecting wire which gives the torsional bars and connecting wire an "S" shaped configuration.

Additional benefits and advantages of the present invention will become apparent to those skilled in the art to which this invention relates from the subsequent description of the preferred embodiments and the appended claims, taken in conjunction with the accompanying drawings.

DETAILED DESCRIPTION OF THE DRAWINGS

Figure 1:
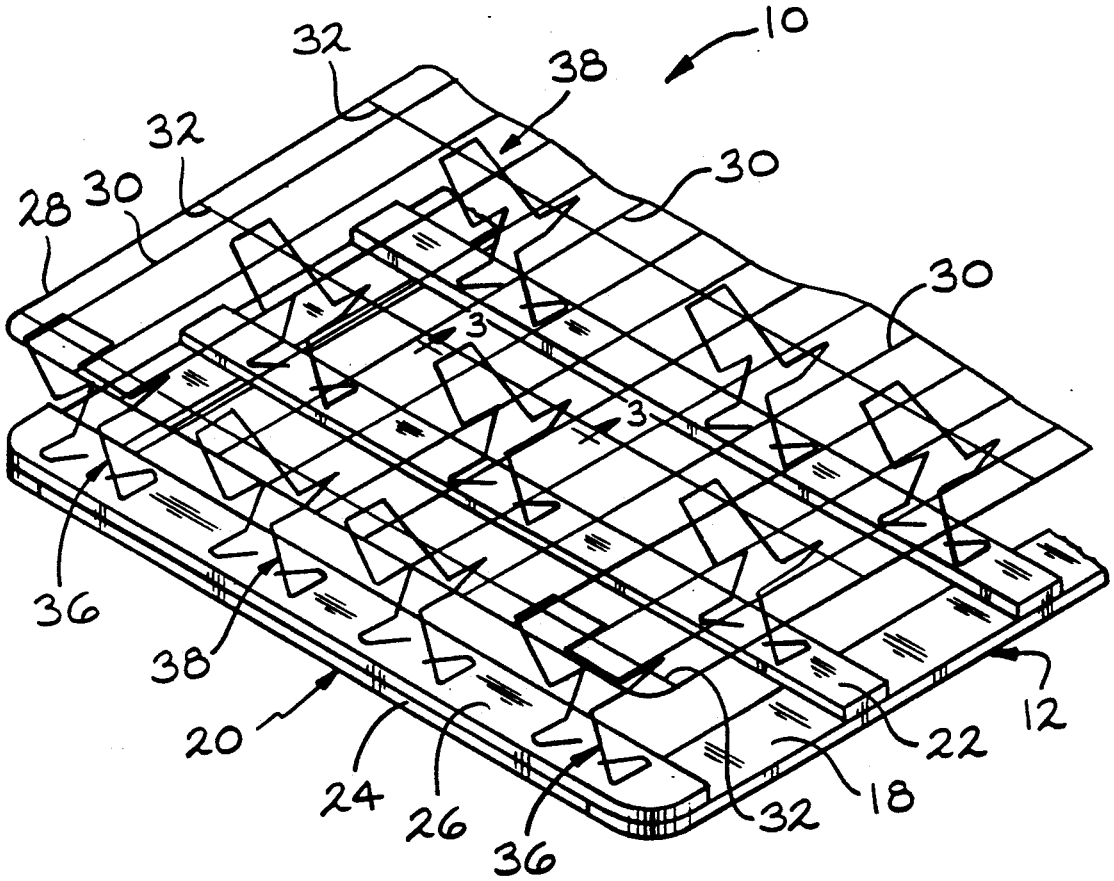
FIG. 1 is a fragmentary perspective view of a portion of the box spring assembly of the present invention, illustrating both the dependent positioning and the independent positioning of the springs.

With reference to the drawing, a fragmentary portion of a box spring assembly constructed according to the principles of this invention is indicated generally at 10. The box spring assembly 10 includes a generally rectangular, horizontally disposed frame 12, a plurality of springs modules 36 and a horizontally disposed welded wire grid or mattress support deck 16 positioned a predetermined distance above the frame 12.

The frame 12, generally constructed of wood, includes side rails 18, end rails 20 and cross rails 22. Each end rail includes a lower member 24 and an upper member 26, both of which are connected at their respective ends to a side rail 18. The lower member 24 is positioned between opposing side rails 18, while the upper member 26 further secures the frame 12 by overlapping the lower member 24 and the ends of the side rails 18. Positioned parallel to the end rails 20 are a plurality of cross rails 22. The cross rails 22 are coplanar with the upper member 26 of the end rails 20 and, in like fashion, overlap the side rails 18.

The wire mattress support deck 16 forms a horizontal platform and is disposed a predetermined distance above the frame 12. The support deck 16 includes a continuous border wire 28, long wires 30 and cross wires 32. The border wire 28 defines the peripheral boundary of the support deck 16 and is generally vertically aligned with the periphery of the frame 12. Arranged lengthwise in the box spring assembly 10, the long wires 30 generally lie parallel to one another in the plane defined by the border wire 28. The long wires 30 terminate in end sections 34 that are secured to the border wire 28 in any conventional manner including being wrapped around the border wire 28 or being welded thereto. The cross wires 32 of the support deck 16 extend substantially perpendicular to the long wires 30 and parallel to one another, while also being generally coplanar with the border wire 28 and long wires 30. The cross wires 32 are positioned such that when the support deck 16 is properly mounted in the assembly 10, each cross wire 32 vertically corresponds with either an end rail 20 or a cross rail 22 of the frame 12.

Generally box spring assemblies have both a load bearing portion and a yieldable portion. In the present invention, the load bearing portion is represented by the support deck 16 while the yieldable portion is generally represented by the spring modules 36. As previously mentioned, the support deck 16 is disposed a predetermined distance above the frame 12 and is maintained and supported at this distance by the plurality of spring modules 36.

The box spring assembly 10 of the present invention consists of three general components; the frame 12, the support deck 16, and the springs modules 36. The springs modules 36 are of the general construction shown in Applicant's prior U.S. Pat. No. 4,891,853 and are further illustrated in three embodiments. As best seen in FIG. 1, the entire support deck 16 is supported by only the spring modules 36. The springs modules 36 are designed to fully secure the support deck 16 and eliminate the need of attachment clips in the assembly 10.

Figure 2:
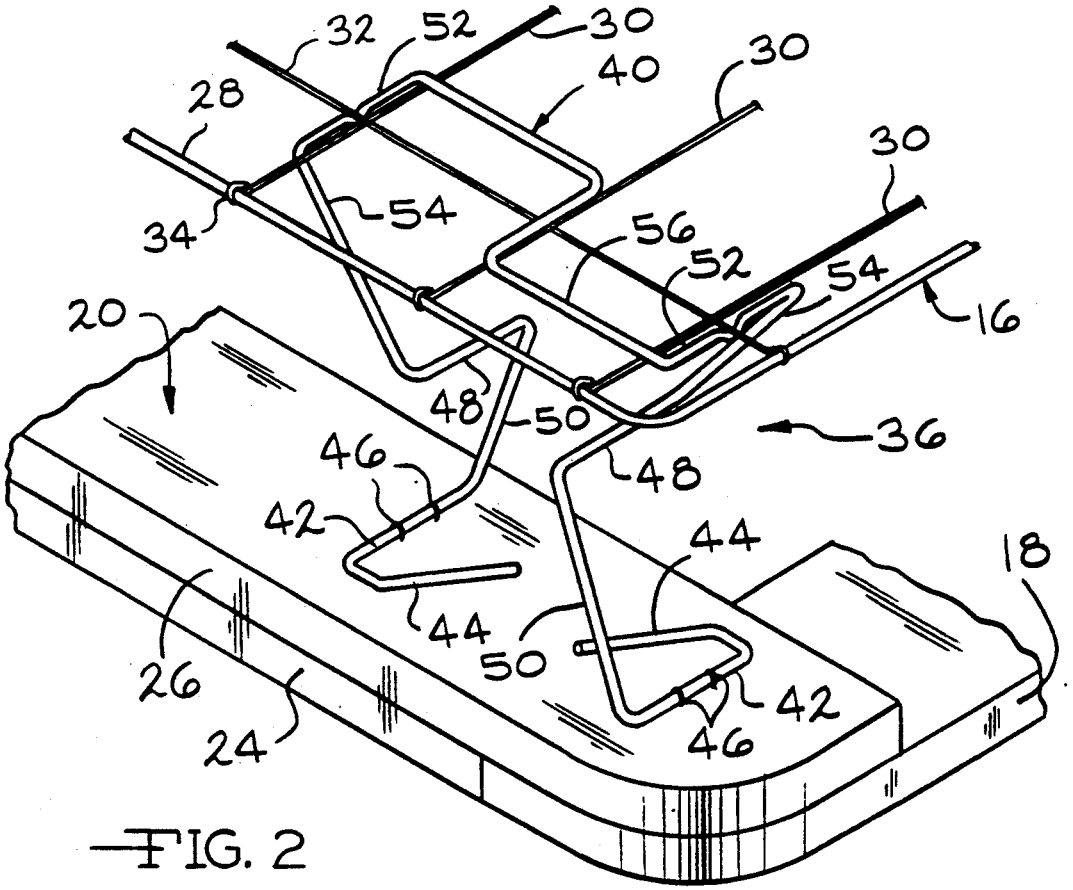
FIG. 2 is an enlarged fragmentary perspective view of a corner of the box spring constructed according to the principles of the present invention.

As seen in FIGS. 1 and 2 the corners of the box spring assembly 10 are provided with spring modules 36 so as to prohibit lateral movement of the support deck 16. This is accomplished by positioning the corner spring modules 36 so as to be dependent upon the long wires 30 of the support deck 16. In the dependent mounting, more fully described below, the spring module 36 spans three adjacent long wires 30 and locks onto the deck 16 so as to interferingly engage lateral movement of the two non-adjacent long wires 30.

Figure 3:
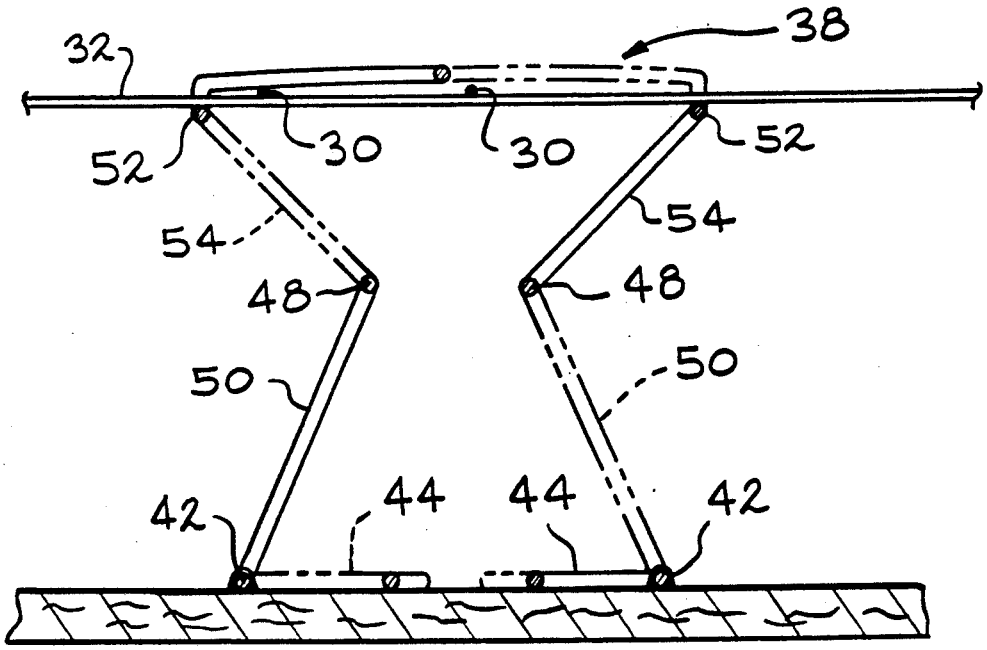
FIG. 3 is an enlarged sectional view taken substantially along line 3—3 in Figure illustrating the independent positioning of spring relative to the long wires.

As seen in FIGS. 2 and 3, each spring module 36 is a limited deflection spring composed of identical halves joined by a lock-wire or connecting wire section 40. Each half of the spring module is similarly constructed and consist of a generally horizontal upper torsional member or end bar 52 connected by a vertically deflectable column section to a generally horizontal lower torsional member 42. The upper torsional members 52 are configured to be non-parallel to the longwires 30 and can thus be a variety of shapes. The non-parallelism of the upper torsional members 52 prevents side-by-side contact with the long wires 30, and thus noise, when the spring 36 is dependently mounted.

The lower torsional member 42 is supported on either an upper member 26 of the end rails 20 or one of the cross rails 22. Each lower torsional member 42 further includes a mounting foot 44 extending from one end thereof. Both the mounting foot 44 and the lower torsional member 42 itself may be secured to the appropriate frame 12 member by staples 46.

As mentioned previously, deflectable columns connect the lower torsional members 42 to the upper torsional members 52. As best seen in FIG. 3, a generally horizontal middle torsional member 48 is disposed vertically between the lower torsional member 42 and the upper torsional member 52 and slightly inward toward the medial line of the intermediate spring 38. From one end of the middle torsional member 48 extends a lower connecting member 50. The connecting member 50 connects the middle torsional member 48 to a corresponding end of the lower torsional member 42. Similarly, an upper connecting member 54 connects the opposite end of the middle torsional member 48 to a corresponding end of the upper torsional member 52. As seen in figures, all embodiments are analogously constructed.

The spring modules 36 will exhibit limited deflection characteristics during the application of substantial vertical loads. Thus, the middle torsional members 48 will be deflected towards one another. Upon the middle torsional members 48 contacting one another, the spring 36 will become rigid and prohibit further deflection.

Figure 4:
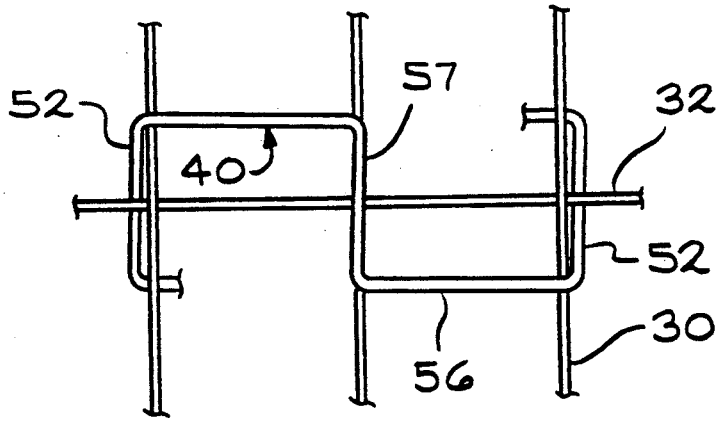
FIG. 4 is an enlarged plan view illustrating a portion of one embodiment of the present invention.
Figure 5:
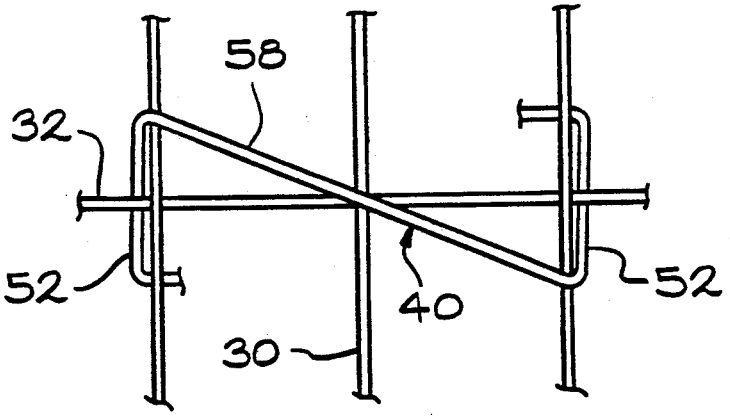
FIG. 5 is an enlarged plan view illustrating a portion of a second embodiment of the present invention.
Figure 6:
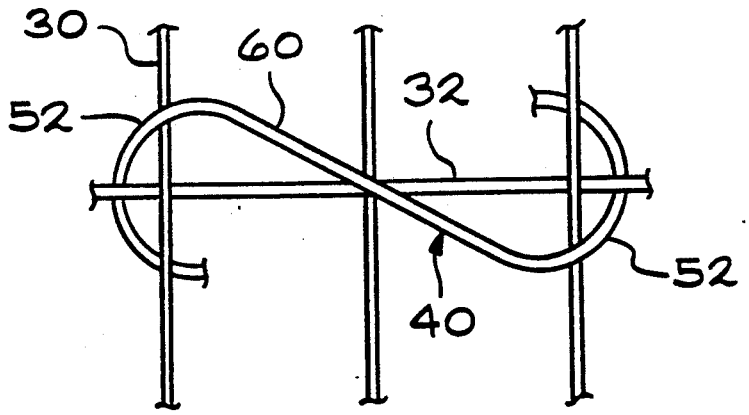
FIG. 6 is an enlarged plan view illustrating a portion of a third embodiment of the present invention.

As described so far, the three embodiments of the springs 36 are identical. It is generally with respect to the connecting members 40 that they differ. The connecting member 40 of the embodiment of, FIG. 4 has a "stairstep" configuration (hereinafter stepped connecting member 56 with intermediate torsion bar 57), while in the second embodiment (FIG. 5), the connecting member 40 has a "straight diagonal" configuration (hereinafter diagonal connecting member 58). In FIG. 6, the third embodiment is shown with a curved connecting member (hereinafter S-connecting member 60 and curved upper torsional bars 52). Common to all embodiments is that upper torsional bars 52 are non-parallel to the long wires 30 thereby preventing contact between the two and likewise reducing spring noise from such contact. In all of the embodiments, only point to point contact is made with the long wire 30 where, the connecting member 40 merges into the upper torsional bar 52 at a merger portion.

The differing configurations are shown as alternative and illustrative embodiments of the springs 36 capable of being employed. Continuing along this same line of reasoning it should be realized that the springs 36 can be used interchangeably without altering the basic principles of the invention.

As mentioned previously the springs 36 provided in the corners of the assembly 10 restrict the lateral movement of the support deck 16. The dependent mounting of corner springs 36 is shown for illustrative purposes only and it is readily apparent that the springs 36 which restrict movement of the deck 16 can be positioned elsewhere in the assembly 10, so long as mounted in a dependent fashion relative to the long wires 30. For example, the movement restricting springs 36 could be positioned along the longitudinal sides of the assembly 10. In this dependent mounting, where the connecting member 40 merges with the upper torsional bars 52, the springs 36 make point contact with the long wires 30 and interfere with lateral movement of the deck 16.

Since the remaining springs 36 are not required to limit movement of the support deck 16, these springs 36 may be positioned as desired by the manufacture for optimum comfort without regard to the position of the long wires 30. As mentioned previously, the remaining springs 36 of the assembly 10 are inserted into the assembly 10 so as not to be dependent on the long wires 30. In so doing, the springs 36 are positioned so that the connecting member 40 will cross over the two long wires 30 and the upper torsional members 52 will extend beneath a cross wire 32, thus giving the assembled spring 36 an interwoven appearance with the support deck 16. In this manner, the spring 36 is capable of being positioned where desired or required by the manufacturer. The diagonal and S-shaped embodiments of the connecting member 40 are desirable because they permit a lesser amount of spring wire to be employed in the construction of the spring 36 and thus reduce cost without affecting quality.

While the above description constitutes the preferred embodiments of the present invention, it will be appreciated that the invention is susceptible to modification, variation and change without departing from the proper scope and fair meaning of the accompanying claims.

I claim:

1. A box spring assembly comprising a generally horizontal frame having a generally horizontal welded wire grid disposed a predetermined distance above said frame, said grid including a plurality of straight wires arranged criss-cross fashion, some of said wires extending lengthwise as longwires of said grid and other of said wires extending crosswise as crosswires of said grid, and a border wire supporting said lengthwise and crosswise wires, said border wire being of generally rectangular shape having side sections and end sections; a plurality of grid support springs arranged between and secured to said grid and said frame so as to yieldably support said grid on said frame, each of said grid support springs being mounted at its upper end on a grid crosswire and including an upper grid attaching section which includes a pair of horizontally spaced end bard and a connecting wire section extending therebetween, said end bars extending generally transversely of and engaging at their mid-sections the under side of said cross wire and said upper grid attaching section being firmly engaged with the top side of at least one of said grid longwires at a position between said end bars so as to clamp said crosswire to said spring attaching section, each of said end bars merging into said connecting wire section at a merger portion of said upper grid attaching section and in at least some of said springs at least one of said merger portions being positioned adjacent to and engageable with the top side of one of said grid longwires to limit side-to-side movement of said grid relative to said frame, said end bars being non-parallel to said longwires to avoid contact between said end bars and said longwires except for the engagement of said merger portions with one of said longwires.

2. A box spring assembly as set forth in claim 1 wherein said connecting wire section is a stairstepped configuration.

3. A box spring assembly as set forth in claim 1 wherein said connecting wire section is a straight diagonal configuration.

4. A box spring assembly as set forth in claim 1 wherein said connecting wire section is an S-shaped configuration having curved end bars.

5. A box spring assembly comprising a generally horizontal frame having a generally horizontal welded wire grid disposed a predetermined distance above said frame, said grid including a plurality of straight wire arranged crisscross fashion, some of said wires extending lengthwise as longwires of said grid and others of said wires extending crosswise as crosswires of said grid, and a border wire supporting said lengthwise and crosswise wires, said border wire being of generally rectangular shape having side sections and end sections, a plurality of spring modules arranged between said grid and said frame at random positions on said crosswires not predetermined by the positions of said longwires, said spring modules being interlockingly secured to said grid so as to yieldably support said grid on said frame, said longwires being located without regard to location of said spring modules on said grid; and some of said spring modules including means coacting with said grid to insure against substantially horizontal movement of said grid on said spring modules, said means comprising a pair of horizontally spaced end bars and a connecting wire section extending therebetween and merging into said end bars at merger portions positioned adjacent to and engageable with the top side of one of said grid longwires, some of said merger portions being located with respect to said grid to solely make point-to-point contact with a longwire adjacent thereto to thereby prevent movement of said grid on said spring modules, said end bars being non-parallel to said longwires to avoid contact between said end bars and said longwires except for the engagement of said merger portions with one of said longwires.

* * * * *